United States Patent [19]

Nagano et al.

[11] 4,362,594

[45] Dec. 7, 1982

[54] APPARATUS FOR STICKING LABELS TO CONTAINERS

[75] Inventors: Yasuaki Nagano, Kanazawa; Toshiaki Naka, Tatsunokuchi, both of Japan

[73] Assignee: Shibuya Kogyo Co., Ltd., Ishikawa, Japan

[21] Appl. No.: 245,452

[22] Filed: Mar. 19, 1981

[30] Foreign Application Priority Data

Jun. 2, 1980 [JP] Japan ..... 55-74112

[51] Int. Cl.[3] ..... B31F 1/00

[52] U.S. Cl. ..... 156/567; 156/569; 156/578

[58] Field of Search ..... 156/456, 457, 446, 566–572, 156/578

[56] References Cited

U.S. PATENT DOCUMENTS 3,516,297 6/1970 Dullinger ..... 156/567 X

*Primary Examiner*—David A. Simmons

*Attorney, Agent, or Firm*—Majestic, Gallagher, Parsons & Siebert

[57] ABSTRACT

A turntable is rotatably provided on the main body of a label sticking apparatus, and a plurality of container support tables are provided along the periphery of the turntable. Containers such as bottles and cans are transported along a predetermined path as riding on the container support tables. A label application device for applying labels to these containers is formed as a unit block which may be detachably mounted on the main body. When mounted, the label application device receives driving force from the driving source for rotating the turntable. The label application device is provided with a lock mechanism, which enables to carry out mounting and dismounting operations with ease and security.

8 Claims, 4 Drawing Figures

APPARATUS FOR STICKING LABELS TO CONTAINERS

BACKGROUND OF THE INVENTION

The present invention relates to an apparatus for sticking labels to containers such as bottles and cans, and, in particular, to a label sticking apparatus having a main body to which label application devices for applying labels to containers are detachably mounted.

It is a common practice to stick labels, which indicate contents, producers and distributors, onto containers such as bottles and cans after having them filled with contents. Such a label sticking apparatus for sticking labels to containers generally comprises a transporting device for transporting containers along a predetermined path, and at least one label application device disposed at a position of the predetermined path. Label application devices may be provided as many as the number of labels to be stuck to a container. Each label application device comprises a magazine for storing a quantity of labels, a label application drum for applying labels to containers, and a supply mechanism for supplying labels from said magazine to the label application drum one by one with gluing one side surface of the label.

Labels are required to be stuck to containers properly at desired positions, and, therefore, the drive of the label application devices must be synchronized with the drive of the container transporting device. In other words, the rate of rotation of the label application drum of each label application device must have a certain relationship with the travelling speed of the containers transported by the transporting device. In order to satisfy this requirement, it has conveniently been so structure that label application devices are driven by the driving source of the container transporting device. Such a structure is advantageous because it is simpler as compared with the case in which separate driving sources are provided for a container transporting device and a label application device. Moreover, provision of separate driving sources will require a mechanism for synchronizing the two entities, which indicates further complication in structure.

Meanwhile, even if use is made of a single driving source as in the prior art technique, there still remains disadvantages owing to the semi-permanently integrated structure between the container transporting device and the label application devices. For example, it is occasionally desired to change labels and containers to which the labels are to be stuck. If it happens, the customary apparatus will require elaborate adjustments, for example, for the label supply mechanism and the label application drum so that labels, when changed, may be properly stuck to the desired positions of a container. Such adjustments can be done by a skilled artisan only with an exorbitant amount of time. Furthermore, new labels might not fit to the existing label application devices because of their size or shape. Thus, if one wants to use new labels which are too big for the existing label application devices must purchase another label sticking apparatus designed especially for the new labels. Alternatively, the new labels must be disposed of. New labels are usually designed and used for new products with a view to attracting buyer's attention. However, since the prior art apparaus is not so flexible, label designing is necessarily limited.

SUMMARY OF THE INVENTION

The present invention provides for a label sticking apparatus in which a label sticking device is formed as a unit block which may be detachably mounted on the main body of the apparatus provided with a container transporting device. In accordance with the present invention, a label application device, when mounted on the main body, is driven by the driving source of the container transporting device so that the transporting velocity of containers may be automatically and accurately synchronized with the rate of rotation of the label application drum. When new labels are to be used, only the label application device then mounted needs to be substituted with another label application device for the new labels. Thus, in accordance with the present invention, the substituting operation is very simple and no special skill is required. The label sticking system of the present invention is abundant in flexibility and it does not impose any restraints on label designing.

Provision of a lock mechanism in the present label application device makes mounting and dismounting operations of the label application device simpler and more secure. It is preferable to structure such lock mechanism in such a manner that it is automatically locked or unlocked as it is mounted on or dismounted from the main body of the apparatus.

Therefore, it is a primary object of the present invention to provide for a label sticking apparatus in which a label application device is formed as a unit block which may be detachably mounted on the main body of the label sticking apparatus.

It is another object of the present invention to provide for a label sticking apparatus which may be easily adapted even if the size and/or shape of labels and/or containers such as bottles and cans are changed.

It is a further object of the present invention to provide for a label sticking device for sticking labels to containers, such as bottles and cans, transported along a predetermined path, which may be detachably mounted at a desired position of the path.

It is a still further object of the present invention to provide for a label application device having a lock mechanism in order to facilitate and insure mounting and dismounting operations.

Other objects, advantages and novel features of the present invention will become apparent from the following detailed description of the invention when considered in conjunction with the accompanying drawings.

DESCRIPTION OF THE PREFERRED EMBODIMENTS

Figure 1:
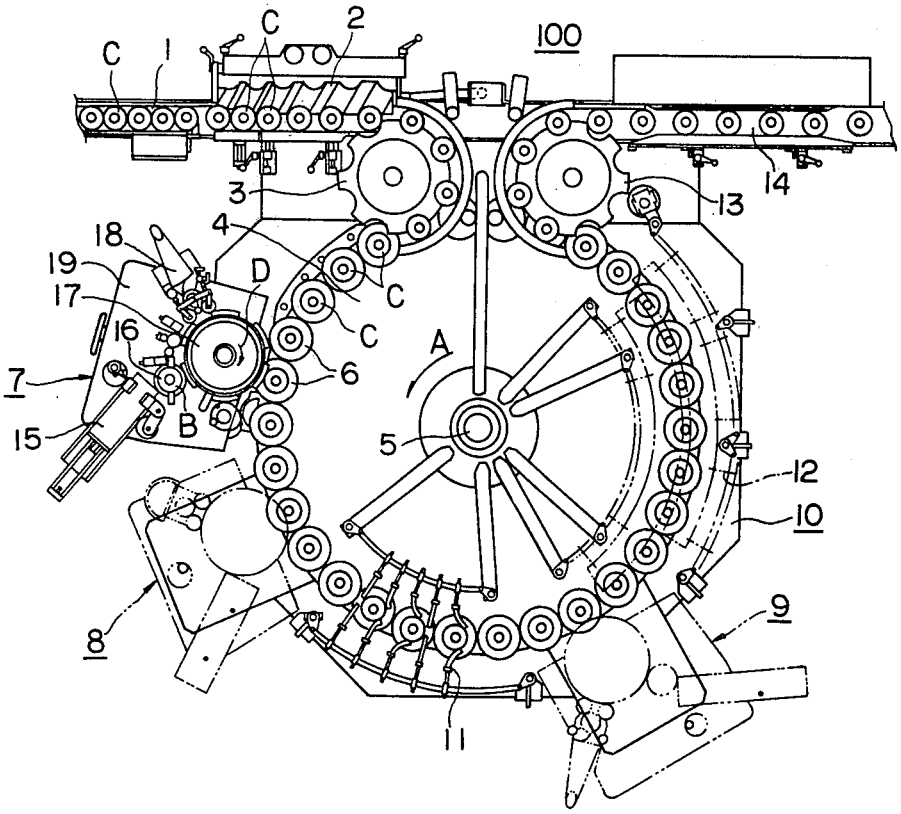
FIG. 1 is a plan view showing the overall structure of a label sticking apparatus.

Referring to FIG. 1, containers C such as bottles or cans are delivered to a label sticking apparatus 100 from a previous station as riding on a conveyor 1. The containers C are transferred from the conveyor 1 to a timing screw 2 where the space between the adjacent containers C is set to a desired valve. At the other end of the timing screw 2 is disposed a star wheel 3 which is driven to rotate in synchronism with the timing screw 2. Upon reaching the star wheel 3, the containers C change the direction of advancement and they are transferred onto a turntable 4. The turntable 4 is provided to be rotatable around a shaft 5 in the direction indicated by the arrow A, and it is provided with a plurality of container support tables 6 disposed along its periphery. As the turntable 4 rotates, containers C are continuously supplied to the container support tables 6 from the star wheel 3, and, therefore, the containers C are transported along a predetermined circular path.

In the periphery of the turntable 4, there are disposed three label application devices 7,8 and 9, which indicate that the present label sticking apparatus 100 is capable of sticking at least three different labels to an individual container. The label sticking apparatus 100 has a main body 10 which supports the turntable 4 rotatably, and the label application devices 7, 8 and 9 are mounted on the main body 10. The main body 10 is also provided with stroking brushes 11 and 12 which will come into rubbing contact with labels applied to the containers C by the label application devices 7, 8 and 9 and press them firmly and smoothly against the surface of the containers. Thereafter, the containers C are transferred from the turntable 4 to a conveyor 14 through another star wheel 13, and then the containers C are delivered to the next station.

Now, detailed explanation will be had with respect to the structure of the label application devices 7, 8 and 9. In FIG. 1, the devices 8 and 9 are only schematically shown by phantom lines and their fundamental structure is the same as that of the device 7. The label application device 7 comprises a magazine 15 for holding a quantity of labels, a delivery roller 16 driven to rotate in the direction indicated by the arrow B for picking up labels one by one from the magazine 15, a label application drum 17 driven to rotate in the direction indicated by the arrow D for applying labels received from the delivery roller 16 to containers C on the container support tables 6, and a glue application mechanism 18 for applying glue on one side surface of the labels held on the label application durm 17. The driving force for the delivery roller 16, label application drum 11, etc, is transmitted from a driving source through a driving gear provided integrally with the turntable 4 for corotation around the shaft 5. That is, each of the label application devices 7, 8 and 9 is provided with a timing gear which may be meshed with the driving gear for the transfer of driving force from a driving source to the delivery roller 16, label application device 17, etc.

Figure 2:
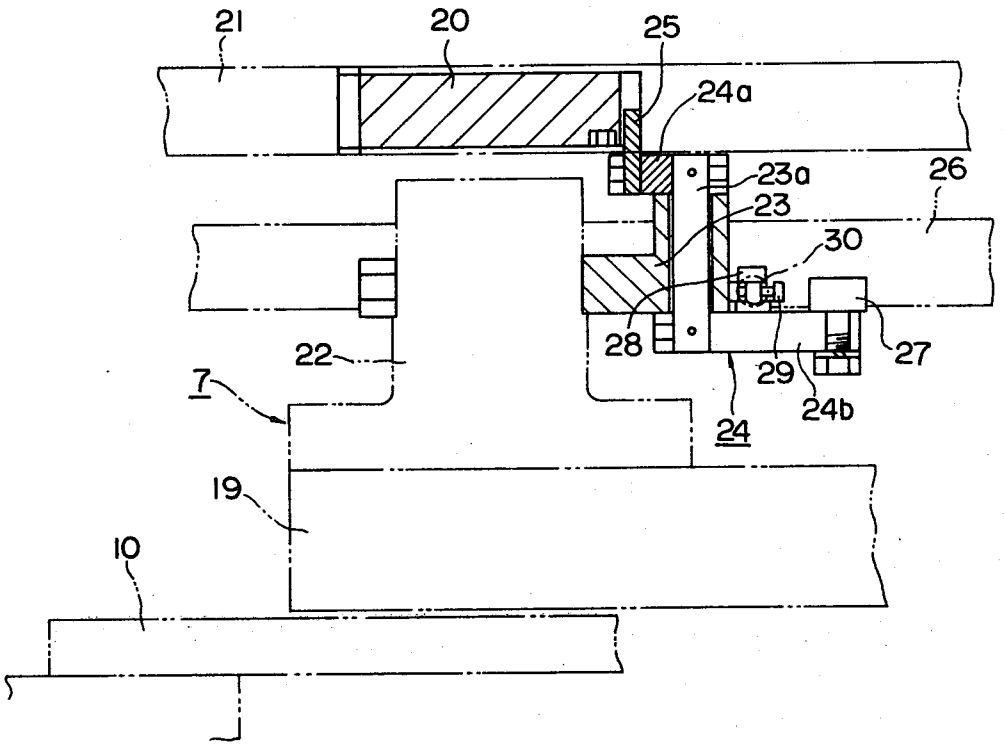
FIG. 2 is an enlarged view showing main parts when a label application device is mounted on the main body in accordance with one embodiment of the present invention.
Figure 3:
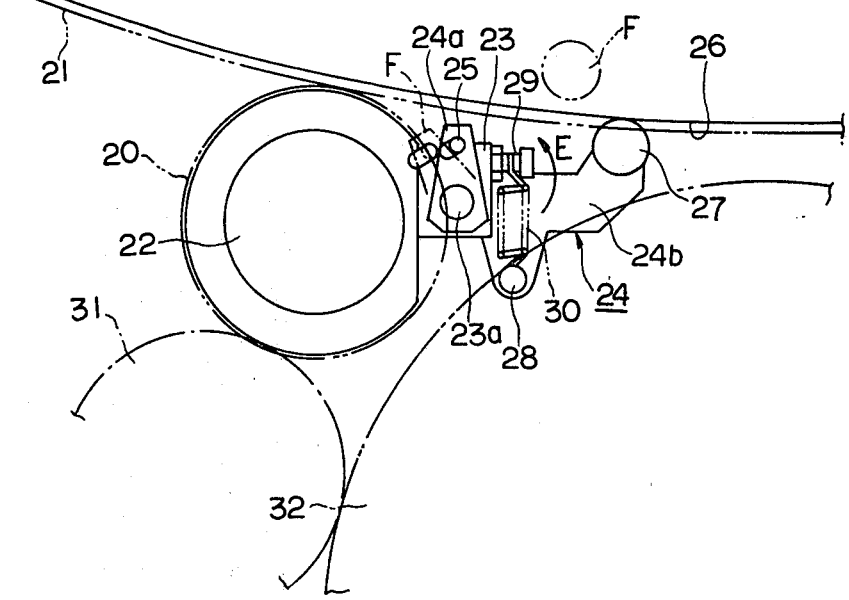
FIG. 3 is a plan view of the embodiment shown in FIG. 2.

In accordance with the present invention, the label application devices 7, 8 and 9 are formed as a unit block which may be detachably mounted on the main body 10 of the label sticking apparatus 100. FIGS. 2 and 3 show the situation when the label application device 7 is mounted on the main body on an enlarged scale. The label applicaton device 7 has a support plate 19 on which are disposed a magazine 15, a delivery roller 16, a label application drum 17 and a glue application mechanism 18. Although it is not specifically shown in these figures for the sake of simplification, the label application device 7 is also provided with gears, air pipes, etc. for the cooperation between components, thus forming an independent unit structure. As a result, the label application devices 7, 8 and 9 may be directly mounted on the main body 10 without any elaborate preparatory work.

It is to be noted that various conventional techniques may be employed for mounting the label application devices 7, 8 and 9 to the main body 10. For example, one may provide a guide member, such as a slot or rail, on the main body 10 and a projection depending from the bottom surface of the support plate 19. And, when mounting, the projection may be brought into engagement with the guide member. Furthermore, the cooperation between the projection and the guide member may be used to attain proper positioning of the label application devices. Besides, when the label application devices are properly positioned by the engagement between the projection and the guide member, bolts may be used to firmly secure the label application devices at their desired positions. Therefore, in accordance with the present invention, if new labels or new bottles are to be used, it is only necessary to mount another label application device for that specific situation, and, since the label application device is formed as a unit block, it can be easily mounted and it does not require any special skills such as adjustments of each component. It can be easily appreciated that the present invention made it possible to start label sticking operation immediately upon mounting a desired label application device. This aspect is quite important since the present apparatus is usually used as a part of a whole container handling line. That is, a halt period of the whole line can be minimized even if label application devices must be exchanged owing to the change of labels and/or containers.

As shown in FIGS. 2 and 3, a support member 22 is firmly fixed to the support plate 19 of the label application device 7, and a timing gear 20 is rotatably provided at the top portion of the support member 22. The timing gear 20 is in mesh with the driving gear 21 coaxially and integrally provided below the turntable 4. Extended laterally from the support member 22 and then upwardly is a bracket 23, and a lock member 24 is disposed in its vicinity. The lock member 24 comprises a vertical shaft 23*a* rotatably supported by the bracket 23, an upper arm 24*a* fixedly mounted at the top portion of the shaft 23*a* and projecting towards the driving gear 21, and a lower arm 24*b* fixedly mounted at the bottom portion of the shaft 23*a* and projecting in the direction approximately vertical to the projecting direction of the upper arm 24*a*, as best shown in FIG. 3. Furthermore, the upper arm 24*a* is provided with a pawl 25 which extends upwardly from the arm 24*a* and which is engageable with the timing gear 20. On the other hand, at the forward end of the lower arm 24*b* is provided a roller 27 which may roll along a stationary cam 26 provided coaxially with and below the driving gear 21. The lower arm 24*b* has a projection near the shaft 23*a* and on the other side of the roller 27, and a pin 28 is planted in the projection. A spring 30 is extended between the pin 28 and another pin 29 planted in the bottom portion of the bracket 23. Thus, the lock member 24 as a whole is normally biased in the direction indicated by the arrow E, and, therefore, the pawl 25 is always biased toward the engaging position with the timing gear 20. The label applicaton device 7 is also provided with transmission gears 31 and 32 which are driven to rotate in association with the timing gear 20. The driving force transmitted from the driving gear 21 to the timing gear 20 is then transmitted to the label application drum 17, delivery roller 16, etc. through the transmission gears 31 and 32.

When the label application device 7 is dismounted from the main body 10, the lock member 24 will rotate in the direction indicated by the arrow E in FIG. 3 under the force of the spring 30 to bring the pawl 25 into engagement with the timing gear 20, thereby the timing gear 20 is restrained from rotation. On the other hand, when the label application device 7 is mounted on the main body 10, the roller 27 provided at the forward end of the lower arm 24*b* comes into contact with the stationary cam 26 so that the lock member 24 is rotated in the direction opposite to the arrow E and takes the position shown by the solid lines in FIG. 3. As a result, the timing gear 20 becomes meshed with the driving gear 21 and the pawl 25 is completely disengaged from the timing gear 20, whereby the timing gear 20 may be driven to rotate by the driving gear 21.

As explained above, when the label application device 7 is dismounted from the main body 10, the timing gear 20 is in restraint and prevented from rotation; on the other hand, when the label application device 7 is mounted on the main body 10, the timing gear 20 is released from restraint and set for rotation. It will thus be easily understood that once the synchronism between the label application device 7 and the driving gear 21 is adjusted, no further adjustment is necessary and exchanging operation of label application devices may be carried out quite easily and smoothly without waisting time.

Figure 4:
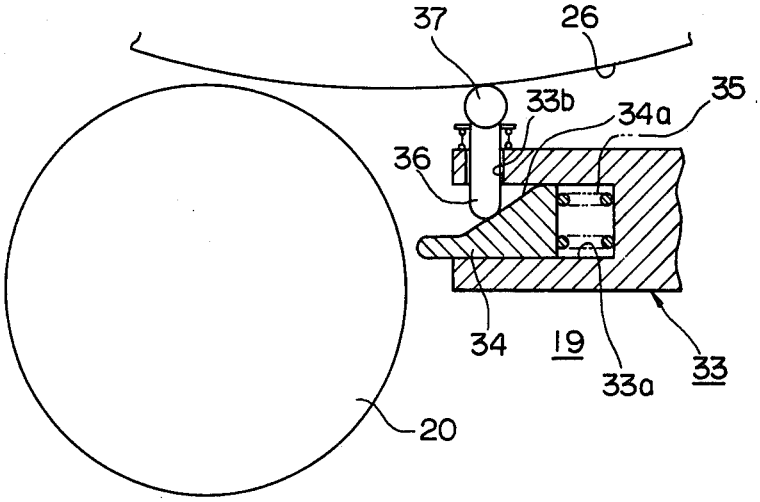
FIG. 4 is an enlarged view showing main parts of another embodiment of the present invention.

FIG. 4 shows another embodiment of the present invention wherein a lock member 33 is fixedly disposed on the support plate 19 and the lock member 33 is provided with a counterbore 33*a* which opens toward the timing gear 20. An engaging member 34, which is engageable with the timing gear 20, is slidably fitted in the counterbore 33*a*, and a coil spring 35 is disposed in the counterbore 33*a* between the bottom of the counterbore 33*a* and the engaging member 34. Thus, the engaging member 24 is normally biased toward the timing gear 20. The engaging member 34 is provided with a slant surface 34*a*; whereas the lock member 33 is provided with a small hole 33*b* extending in the direction approximately vertical to the center axis of the counterbore 33*a*. A rod 36 is slidably fitted in the hole 33*b* with its bottom end in contact with the slant surface 34*a*. At the other end of the rod 36 is provided a roller 37 which may be brought into a rolling contact with the stationary cam 26 of the main body 10. When the label application device 7 is mounted on the main body 10 of the label sticking apparatus 100, the rod 36 is moved into the counterbore 33*a*, which, in turn, moves the engaging member 34 to the right in the drawing, thereby releasing the restrainst of the timing gear 20. On the other hand, when the label application device 7 is dismounted, the roller 37 is not in contact with the cam 26, and, therefore, the engaging member 34 moves to the left in the drawing under the force of the spring 35 to be engaged with the timing gear 20. It should thus be understood that the second embodiment functions in substantially the same manner as that of the first embodiment.

As described above, in accordance with the present invention, even if labels and/or containers are changed to those with different sizes or shapes, label sticking operation can be carried out simply by changing label application devices without any prolonged interruption. Moreover, the present invention requires no special skill and only a minimum time is required for changing label application devices.

While the above provides a full and complete disclosure of the preferred embodiments of the present invention, various modifications, alternate constructions and equivalents may be employed without departing from the true spirit and scope of the invention. Therefore, the above description and illustrations should not be construed as limiting the scope of the invention, which is defined by the appended claims.

What is claimed is:

1. A label sticking apparatus for sticking labels to containers such as bottles and cans comprising:

a main body;

transporting means provided on said main body for transporting said containers along a predetermined path;

driving means for driving said transporting means, said driving means including a driving gear formed integrally with said transporting means; and at least one label application device detachably mounted on said main body for applying labels to said containers transported by said transporting means, said label application device including a timing gear and lock means which is engageable with said timing gear, said lock means setting said timing gear in an unrestrained condition to bring said timing gear into mesh with said driving gear when said label application device is mounted on said main body; whereas, said lock means setting said timing gear in a restrained condition when said label application device is dismounted from said main body.

2. The apparatus as defined in claim 1 wherein said transporting means comprises a turntable provided to be rotatable around a shaft of said main body and said turntable is provided with a plurality of container support tables disposed along the periphery thereof.

3. The apparatus as defined in claim 2 wherein said driving gear is formed integrally with said turntable.

4. The apparatus as defined in claim 1 wherein said label application device comprises a magazine for storing a quantity of labels, a delivery roller for removing labels one by one from said magazine, a label application drum for applying labels to the containers which are being transported by said transporting means, and a glue application mechanism for applying glue to said labels while held on said label application drum.

5. A label application device for applying labels to containers such as bottles and cans which are being transported along a predetermined path, said label application device being detachably mountable at a desired position along said predetermined path and comprising in combination:

a support plate;

a magazine disposed on said support plate for storing a quantity of labels;

removing means disposed on said support plate for removing labels one by one from said magazine;

label application means disposed on said support plate for applying labels transferred from said removing means to said containers;

glue application means disposed on said support plate for applyingg glue to one side surface of said labels;

transmission means having a timing gear which is engageable with a driving gear driven by a driving source to transport said containers for transmitting driving force to said removing means, label application means and glue application means; and lock means including a lock member rotatably disposed on said support plate, said lock member including a pawl which is engageable with said timing gear.

6. The device as defined in claim 5 wherein said lock member is normally biased by spring means with a tendency to bring said pawl into engagement with said timing gear and said lock member further includes a roller which may form a rolling contact with a cam fixedly disposed along said predetermined path.

7. The device as defined in claim 5 wherein said lock means comprises a lock member which is provided with a counterbore with its opening directed toward said timing gear and an engaging member which is slidably fitted in said counterbore and engageable with said timing gear when projected.

8. The device as defined in claim 7 wherein said lock means further comprises a spring means disposed in said counterbore and a rod slidably fitted in a hole provided in said lock member extending in the direction approximately vertical to the center axis of said counterbore, one end of said rod being in abutment with a slant surface formed on said engaging member and the other end of said rod being contactable with a cam fixedly disposed along said predetermined path.

* * * * *